US008311456B2

(12) United States Patent
Murata et al.

(10) Patent No.: US 8,311,456 B2
(45) Date of Patent: Nov. 13, 2012

(54) CLEANING CONTROL OF IMAGE CARRIER IN IMAGE FORMING APPARATUS

(75) Inventors: Hiroki Murata, Mishima (JP); Toshifumi Kitamura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 246 days.

(21) Appl. No.: 12/784,069

(22) Filed: May 20, 2010

(65) Prior Publication Data

US 2010/0316408 A1 Dec. 16, 2010

(30) Foreign Application Priority Data

Jun. 12, 2009 (JP) ..... 2009-141622

(51) Int. Cl.
*G03G 15/00* (2006.01)

(52) U.S. Cl. ..... 399/167

(58) Field of Classification Search ..... 399/71, 399/167, 301, 303, 343, 344, 345
See application file for complete search history.

(56) References Cited

U.S. PATENT DOCUMENTS

| | | | | |
|---|---|---|---|---|
| 6,771,919 | B2 * | 8/2004 | Koide | 399/167 |
| 7,120,376 | B2 | 10/2006 | Saito et al. | |
| 7,177,571 | B2 * | 2/2007 | Sato et al. | 399/167 |
| 7,653,332 | B2 * | 1/2010 | Ehara et al. | 399/167 |

FOREIGN PATENT DOCUMENTS

| | | | |
|---|---|---|---|
| JP | 2005-062280 | A | 3/2005 |
| JP | 2006-091685 | A | 4/2006 |

* cited by examiner

*Primary Examiner* — Hoang Ngo
(74) *Attorney, Agent, or Firm* — Fitzpatrick, Cella, Harper & Scinto

(57) ABSTRACT

Process cartridges are driven by respectively corresponding DC brushless motors. In a cleaning sequence executed after image formation ends, the DC brushless motors operate according to the driving parameters such that acoustic operational noise decreases.

17 Claims, 17 Drawing Sheets

DRIVE TIMES : N
DRIVE INSTRUCTION TIME PERIOD : T0
OFFSET TIME : ta

FIG. 7A

TABLE A

| | OFFSET TIME tn |
|---|---|
| FIRST STATION | 0 |
| SECOND STATION | ta |
| THIRD STATION | 0 |
| FOURTH STATION | ta |

FIG. 7B

TABLE B

| | DRIVE DELAY TIME tn |
|---|---|
| FIRST STATION | 0 |
| SECOND STATION | tc |
| THIRD STATION | tb |
| FOURTH STATION | td |

FIG. 7C

TABLE C

| | DRIVE DELAY TIME tn |
|---|---|
| FIRST STATION | 0 |
| SECOND STATION | tf |
| THIRD STATION | te |
| FOURTH STATION | tg |

FIG. 12A

TABLE A

| | N = 1 | N = 2 | N = 3 | N = 4 |
|---|---|---|---|---|
| FIRST STATION | T1 | T2 | T3 | T4 |
| SECOND STATION | T4 | T1 | T2 | T3 |
| THIRD STATION | T3 | T4 | T1 | T2 |
| FOURTH STATION | T2 | T3 | T4 | T1 |

FIG. 12B

TABLE B

| | AFTER N = 1 | AFTER N = 2 | AFTER N = 3 |
|---|---|---|---|
| FIRST STATION | t1 – 2 | t2 – 3 | t3 – 4 |
| SECOND STATION | t4 – 1 | t1 – 2 | t2 – 3 |
| THIRD STATION | t3 – 4 | t4 – 1 | t1 – 2 |
| FOURTH STATION | t2 – 3 | t3 – 4 | t4 – 1 |

FIG. 14

TABLE C

| | DRIVE DELAY TIME On |
|---|---|
| FIRST STATION | 0 |
| SECOND STATION | ta |
| THIRD STATION | tb |
| FOURTH STATION | tc |

CLEANING CONTROL OF IMAGE CARRIER IN IMAGE FORMING APPARATUS

BACKGROUND OF THE INVENTION

1. Field of the Invention

The present invention generally relates to an image forming apparatus including an image carrier, and particularly to cleaning control of an image carrier.

2. Description of the Related Art

In an image forming apparatus that uses a transfer method that adopts an electrophotographic process or an electrostatic recording process, it is necessary to clean developer that is not transferred to a paper sheet and remains on the surface of an image carrier. If an image carrier and a cleaning blade are left in a state of contact against each other, finely-powdered toner or an additive agent or the like aggregates at the contact regions. These aggregates may cause image defects such as streaks or image blurring (density fluctuations and the like). In general, a friction coefficient μ at a portion at which finely-powdered toner and the like is aggregated on the surface (circumference) of the image carrier decreases relatively. Hence, when a cleaning blade passes through a portion at which the friction coefficient μ has decreased, the rotational speed (circumferential speed) of the image carrier temporarily increases. This is one cause of image defects such as streaks and image blurring.

Japanese Patent Laid-Open No. 2005-062280 discloses an invention that reduces aggregates by stopping an image carrier when image formation ends, and thereafter removing finely-powdered toner by performing microscopic rotation of the image carrier and, furthermore, counter-rotating the image carrier. Japanese Patent Laid-Open No. 2006-091685 discloses an invention that intermittently rotates an image carrier in the same direction as the rotational direction at the time of image formation, and thereafter rotates the image carrier in the opposite direction.

The inventions disclosed in Japanese Patent Laid-Open No. 2005-062280 and Japanese Patent Laid-Open No. 2006-091685 offer excellent advantages with respect to reducing image defects such as streaks and image blurring caused by aggregates such as finely-powdered toner or additive agents by moving the surface (circumference) of the image carrier a predetermined distance after the image carrier has stopped. However, there is a new demand for decreasing operational sounds emitted from a portion at which an image carrier and a cleaning blade contact or from a motor drive gear train or the like when cleaning the image carrier. In this case, the term "operational sound" refers to a sound that is generated in response to driving of an image carrier in a cleaning sequence.

In particular, since a color image forming apparatus includes a plurality of image carriers, operational sounds that are significant in an acoustic sense are liable to occur when the plurality of image carriers are cleaned at the same time. Further, because a cleaning sequence for cleaning is executed after image formation, the discomfort index with respect to a user is liable to increase. The reason is that, although a user is likely to tolerate operational sounds that relate to image formation, there is a tendency for a user to consider an operational sound that has little relevance to image formation as a discomfort. In this case, the term "acoustic sense" refers to a state in which any kind of sound is audible to the human ear. Hence, it is not the case that the physical magnitude of a sound (magnitude of vibrational energy) always corresponds to the magnitude of a sound that is perceived by a human.

SUMMARY OF THE INVENTION

A feature of the present invention is that the invention solves at least one problem among the problems described above and other problems. For example, a feature of the present invention is that the invention suppresses the generation of image defects by a cleaning sequence and also reduces an operational sound. In this connection, other problems will be understood upon reading this entire specification.

The present invention is applicable to an image forming apparatus that, for example, comprises a plurality of image carriers that carry images formed by a developer, a plurality of drive units that drive the plurality of image carriers, and a plurality of cleaning members that clean developer remaining on the plurality of image carriers, respectively, after a process of transferring images carried on the image carriers. The image forming apparatus further comprises a drive control unit that operates the plurality of drive units after image formation has ended to clean the plurality of image carriers; and a configuration unit that configures driving parameters for configuring operational terms of the drive units differently with respect to the plurality of drive units; wherein the drive control unit operates the plurality of drive units according to driving parameters configured by the configuration unit.

Further features of the present invention will become apparent from the following description of exemplary embodiments (with reference to the attached drawings).

BRIEF DESCRIPTION OF THE DRAWINGS

FIGS. 7A to 7C are views that illustrate examples of tables for managing offsets;

FIGS. 12A and 12B are views that illustrate examples of a table used for configuring drive instruction time periods and standby time periods;

FIG. 14 is a view that illustrates an example of a table for managing offsets;

DESCRIPTION OF THE EMBODIMENTS

Embodiments of the present invention are described below. The individual embodiments described hereunder are useful for understanding various concepts of the present invention, such as a superordinate concept, an intermediate concept, and a subordinate concept thereof. Note that the technical scope of the present invention is defined by the claims of the invention, and is not limited by the individual embodiments described hereunder.

[Embodiment 1 ]

Figure 1:
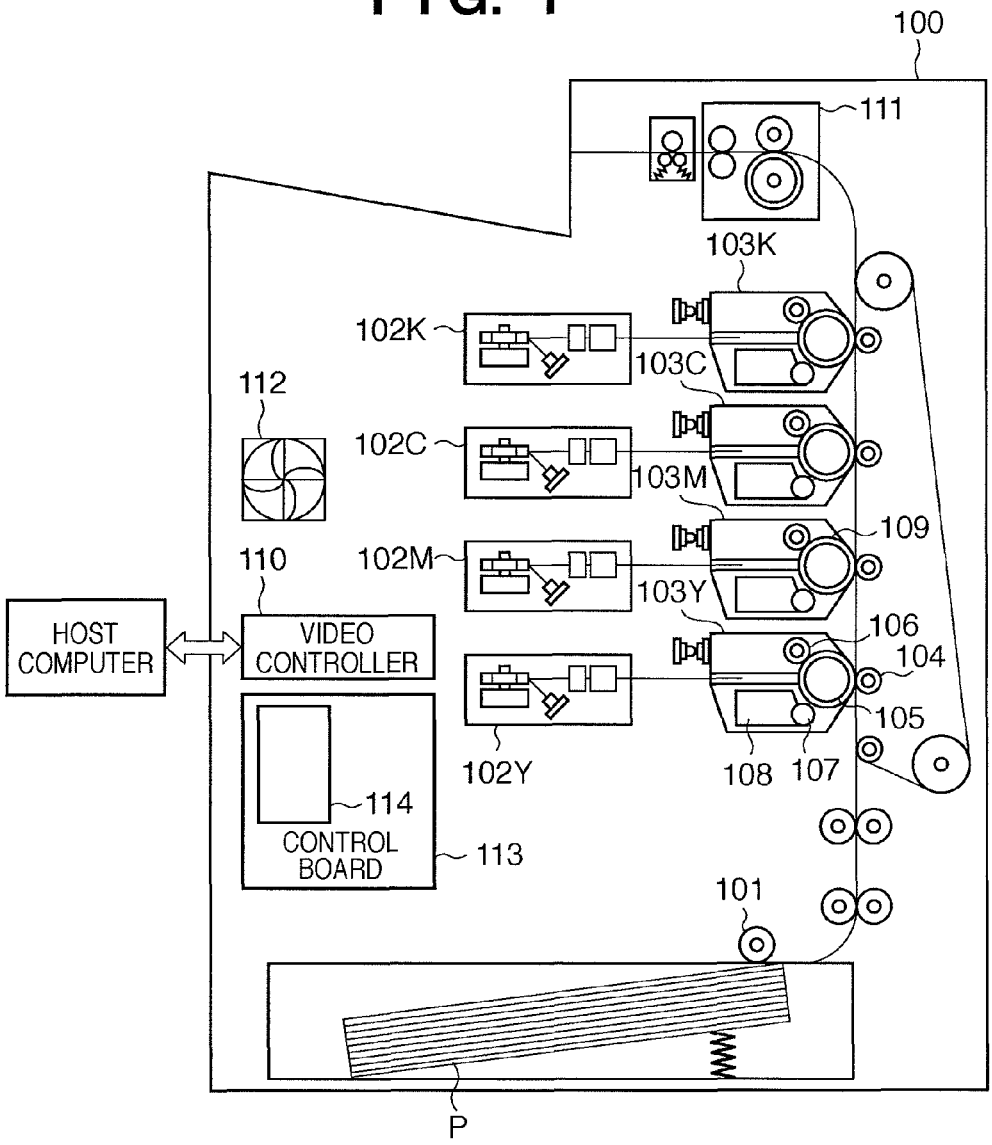
FIG. 1 is a schematic cross section of color laser printer that is one example of an image forming apparatus.

An image forming apparatus illustrated in FIG. 1 may be, for example, any one of a printing apparatus, a printer, a copier, a multifunction peripheral, and a facsimile machine. A laser printer 100 includes a plurality of image forming stations (hereunder, referred to as "station") for forming a color (multicolor) image on a recording paper P. According to the present embodiment, there are four image forming stations for using developer (toner) of four colors (yellow: Y, magenta: M, cyan: C, and black: Bk). More specifically, according to FIG. 1, a first image carrier, a second image carrier, a third image carrier, and a fourth image carrier are arranged in parallel from an upstream side to a downstream side in a recording paper conveying direction in order to superimpose images in sequence. The recording paper may also be referred to as a recording material, a recording medium, a paper, a sheet, a transferring material, and a transferring paper.

Recording paper P that is stored in a paper cassette is fed onto a conveying path by a pickup roller 101, and is conveyed along the conveying path by various conveying rollers. The image forming stations include scanner units 102Y, M, C and K, process cartridges 103Y, M, C and K, and transfer rollers 104. The scanner units 102Y, M, C and K emit laser beams that are modulated based on respective image signals sent from a video controller 110. Thereby, an electrostatic latent image is formed on a photosensitive drum 105 that is an image carrier. Four process cartridges 103Y, M, C, and K each include a photosensitive drum 105, a charging roller 106, a developing roller 107, a toner storage container 108, and a cleaning blade 109 that are necessary for executing an electrophotographic process. An electrostatic latent image that is carried on the surface of the photosensitive drum 105 is developed into a developer image by the developing roller 107, and the developer image is transferred to the recording paper P. The four photosensitive drums 105 are an example of a plurality of image carriers that carry images formed with developer. The cleaning blades 109 are an example of a plurality of cleaning members that clean developer that remains on the corresponding image carriers after an image transferring process. In this connection, a cleaning mechanism that is different to the cleaning blade 109 may be adopted as a cleaning member as long as an operational sound is generated thereby. A fixing apparatus 111 is a unit that heats and fixes a transferred toner image on the recording paper P.

A fan motor 112 is an example of a cooling apparatus that cools the inside of the image forming apparatus. The fan motor 112 is controlled by a CPU 114 mounted on a control board 113, and maintains a temperature inside the image forming apparatus at a desired value. During an image forming operation, the CPU 114 increases a voltage applied to the fan motor 112 to a voltage that is greater than a voltage in an idle state in order to suppress a rise in temperature. This is referred to as "full speed drive". While on standby for an image forming operation, the CPU 114 performs "slowdown drive". The rotational speed of the fan motor 112 in slowdown drive is lower than the rotational speed when in full speed drive. It is thereby possible to reduce power consumption and suppress an operational sound to the utmost.

Figure 2:
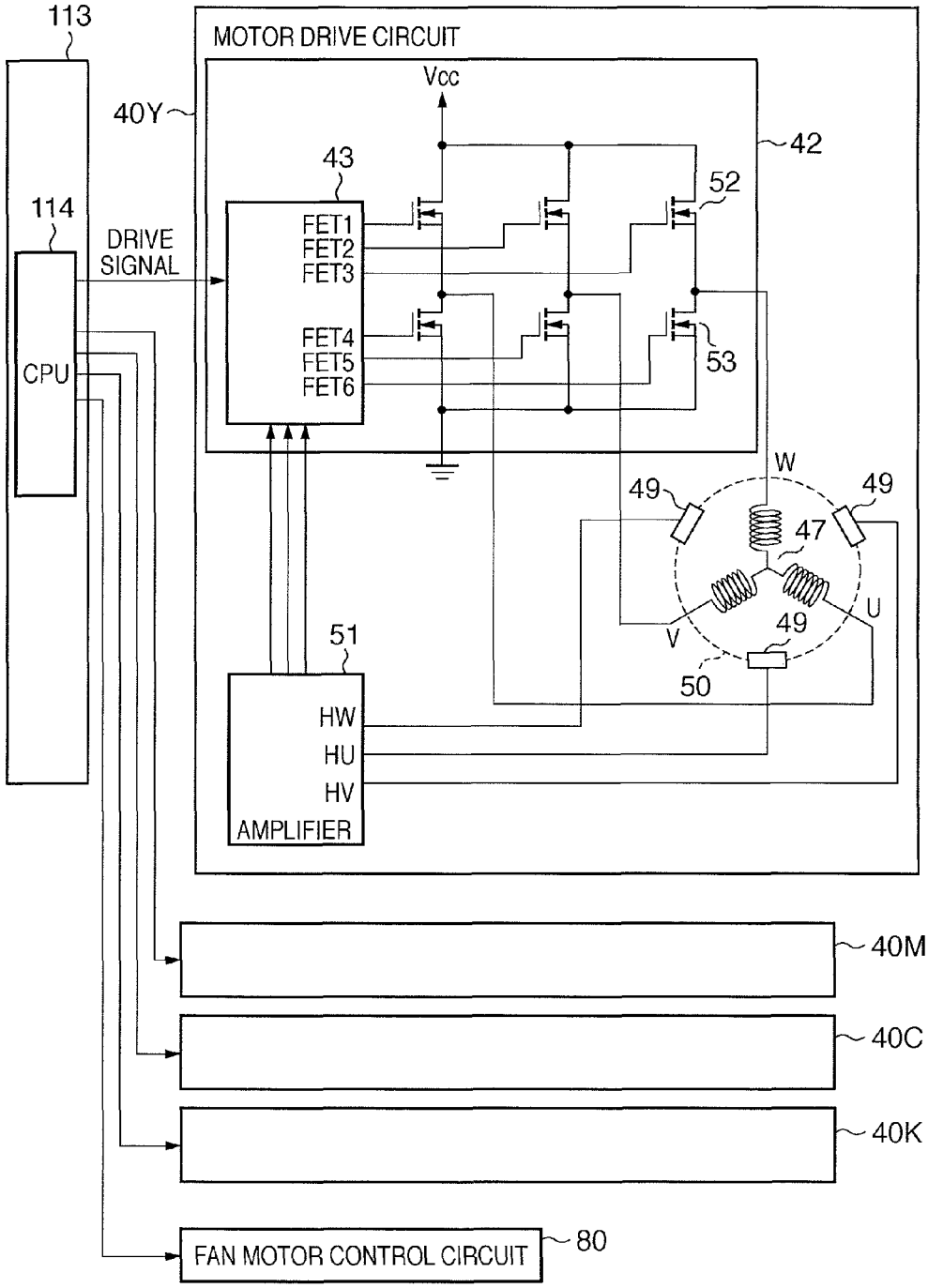
FIG. 2 is a view that illustrates a drive circuit of a DC brushless motor.

FIG. 2 illustrates a drive circuit of a DC brushless motor that is a drive source of the photosensitive drum 105 and the developing roller 107. DC brushless motors 40Y, 40M, 40C, and 40K correspond to image forming stations for each of the colors yellow, magenta, cyan, and black, respectively. The DC brushless motors 40Y, 40M, 40C, and 40K are an example of a plurality of drive units that drive the respectively corresponding image carriers among the plurality of image carriers. The DC brushless motors 40Y, 40M, 40C, and 40K have the same configuration, and hence only the DC brushless motor 40Y is described below.

The CPU 114 sends a drive signal to the DC brushless motor 40Y. A motor drive circuit 42 of the DC brushless motor 40Y controls the DC brushless motor 40Y in order to drive the corresponding process cartridge 103Y in accordance with the received drive signal. The DC brushless motor 40Y includes the motor drive circuit 42, three Hall elements 49 and an amplifier 51. The motor drive circuit 42 includes a motor drive control circuit 43. The motor drive control circuit 43 executes phase switching control based on signals that indicate a rotor position that are output by the three Hall elements 49. Further, the motor drive control circuit 43 controls starting, stopping and the speed of the DC brushless motor in accordance with a control signal from the CPU 114. The DC brushless motor 40Y includes a coil 47 in which three phases of U, V, and W are connected in a star connection, and a rotor 50. The three Hall elements 49 detect a magnetic pole of the rotor 50, and output a detection signal that indicates a position of the rotor to the amplifier 51. The amplifier 51 amplifies the detection signal, and outputs the amplified detection signal to the motor drive control circuit 43. The motor drive control circuit 43 controls six FETs (field-effect transistors) according to the detection signal to thereby rotate the DC brushless motor 40Y.

A fan motor control circuit 80 controls the number of revolutions of the fan motor 112 in accordance with a control signal from the CPU 114. The CPU 114 causes the fan motor 112 to rotate at high speed in an image forming sequence or a cleaning sequence. In contrast, in an idle sequence other than the image forming sequence or the cleaning sequence, the CPU 114 stops the fan motor 112 or causes the fan motor 112 to rotate at low speed. The CPU 114 and the fan motor control circuit 80 function as a cooling control unit that controls starting and stopping of operations of a cooling unit.

Figure 3:
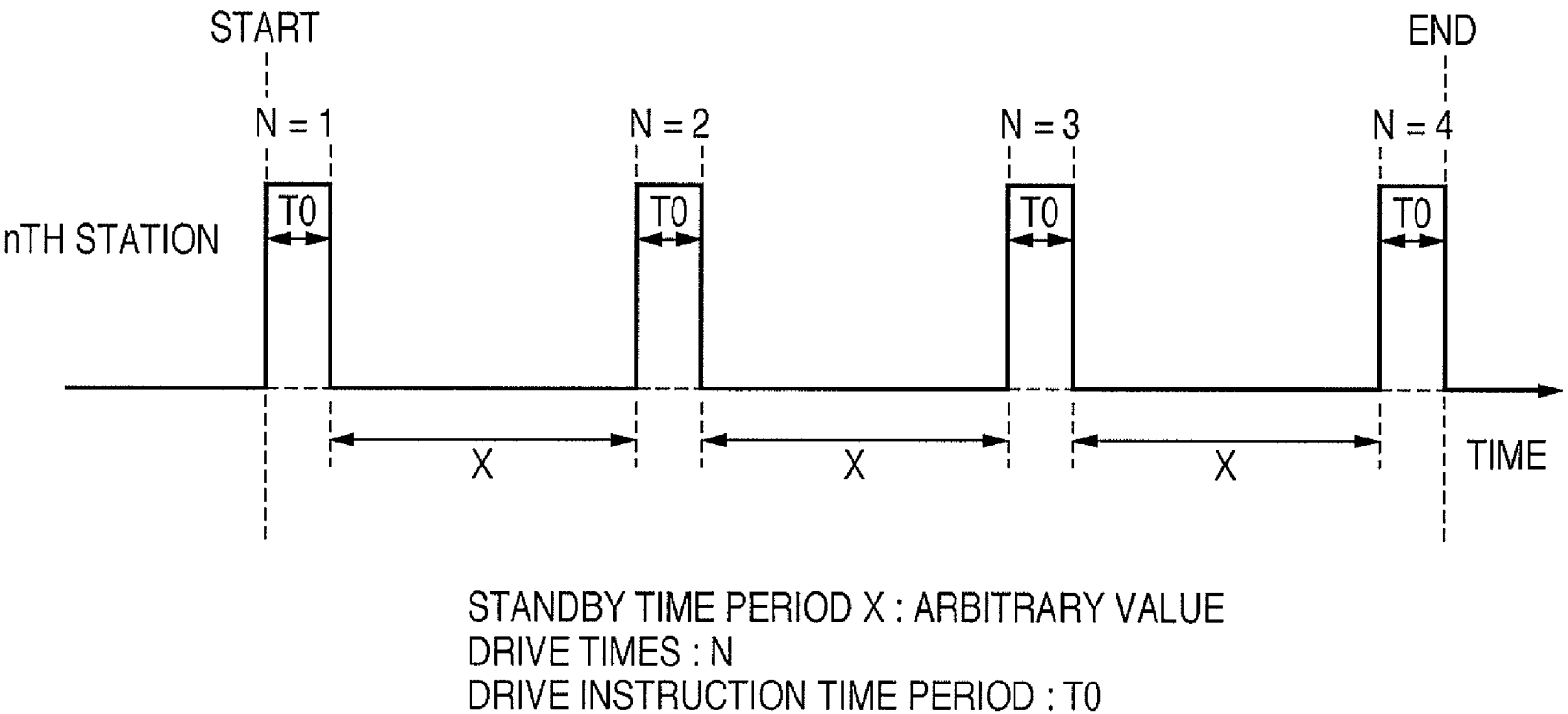
FIG. 3 is a view that illustrates an example of a cleaning sequence.

A cleaning sequence shown in FIG. 3 is a cleaning sequence for removing residual developer that remains on the photosensitive drum 105 using the cleaning blade 109. In this connection, since the photosensitive drum as an image carrier is intermittently subjected to microscopic driving for this cleaning sequence, the cleaning sequence can also be referred to as an image carrier microscopic drive sequence or the like.

In the cleaning sequence, for example, the photosensitive drum 105 is stopped after being intermittently rotated in the same direction as the direction of rotation at the time of image formation. The description in this case focuses on an nth station. The abscissa represents time. Here, the term "station" can be interpreted as corresponding to the process cartridge 103 or as corresponding to a photosensitive drum (image carrier) included in the process cartridge.

According to FIG. 3, the photosensitive drums 105 are driven four times inside the nth station during a period from the start of the sequence to the end. More specifically, the CPU 114 and the motor drive circuit 42 and the like control the plurality of DC brushless motors so as to intermittently drive the plurality of image carriers N (N is a natural number greater than 1) times during the cleaning sequence. The number of photosensitive drums as image carriers and the number of DC brushless motors that drive the photosensitive drums need not necessarily match. The present invention can be applied even when the number of photosensitive drums and the number of DC brushless motors do not match. According to FIG. 3, a time period when drive control of image carriers is continuing (time period for continuing drive control) is configured to be T0 (constant value) for each time from the first time to the fourth time. In this connection, an operational term for driving the motor is determined in correspondence to the time period for continuing drive control.

There is a standby time period X between two adjacent drive instruction time periods. The standby time period X can be set to an arbitrary value. Therefore, the standby time period X between the first drive and the second drive and the standby time period X between the second drive and the third drive may be configured to different values. However, for convenience, an example is described below in which all the standby time periods X are the same (constant value).

The relationship between changes over time in the number of revolutions rpm that depend on whether the drive instruction time period of an image carrier is short or long and changes over time in an operational sound dB is described hereafter using FIGS. 4A-4F. The abscissa in each of the figures from FIG. 4A to FIG. 4F represents time.

The DC brushless motors 40Y to 40K described in FIG. 2 are subjected to constant-speed control at a target speed value that is stored in a storage apparatus (e.g., a RAM or ROM) accessible from the CPU 114. However, according to the present cleaning sequence, motor control is not performed for a speed region in which constant-speed control is performed. According to the present cleaning sequence, a drive signal is sent from the CPU 114, and during acceleration in which the motor does not reach a target speed value, the motor is stopped by a stop signal from the CPU 114. That is, the motor stops before speed information of the motor is fed back to the CPU 114. Since the speed information at that time is not reflected in the operations of the CPU 114, the control appears as if it is feed-forward motor control. This means that speed variations are liable to be generated depending on the load of the image carrier that is the target of driving.

Figure 4A:
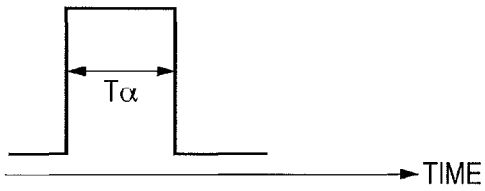
FIGS. 4A to 4F are views that illustrate examples of the number of revolutions of motor control and generated sound amounts in a cleaning sequence.
Figure 4B:
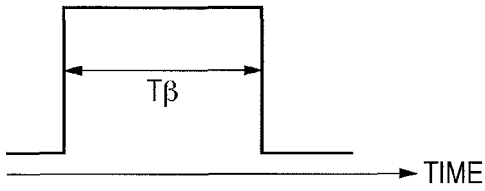
Figure 4C:
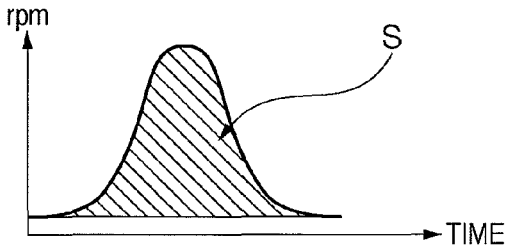
Figure 4D:
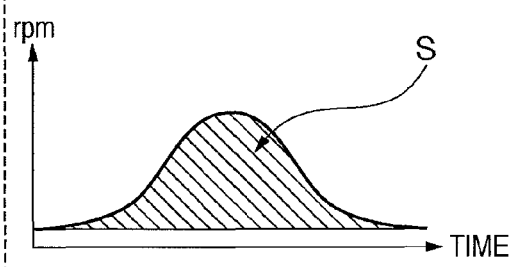
Figure 4E:
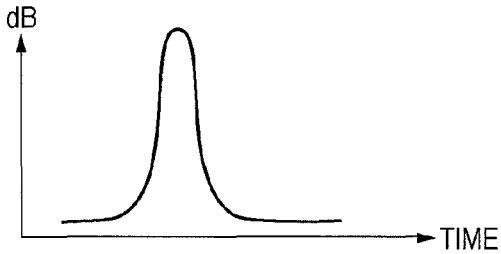
Figure 4F:
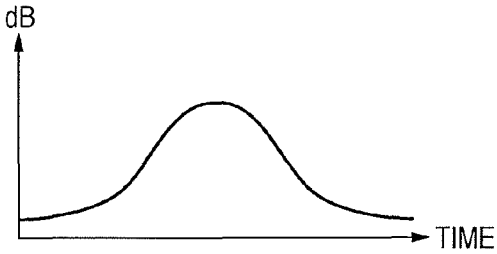

FIG. 4A and FIG. 4B represent drive instruction time periods (drive control time periods) of the DC brushless motor 40. It is assumed that a drive instruction is "on" when a rectangular wave is rising. A drive instruction time period Tα in FIG. 4A is shorter than a drive instruction time period Tβ. In FIG. 4C and FIG. 4D, the ordinate represents the number of motor revolutions. An interval in which the motor is rotating corresponds to a motor driving time period. This motor driving time period approximately matches a drive instruction time period (drive control time period) of the motor. In this connection, the time axes in FIG. 4A, FIG. 4C, and FIG. 4E are synchronous. Likewise, the time axes in FIG. 4B, FIG. 4D, and FIG. 4F are also synchronous. When a drive current value is supplied to the DC brushless motor 40 as shown in FIG. 4A and FIG. 4B, an angular velocity variation appears as shown in FIG. 4C and FIG. 4D. In this connection, the areas S of the two shaded portions are equivalent or approximately equivalent. It is assumed that the moving distances of the image carriers that are integral values are theoretically the same values. The description according to the present embodiment is made assuming that a moving distance of an image carrier is, for example, 1 mm.

FIG. 4E and FIG. 4F represent operational sounds that are generated by a cleaning sequence operation. From the viewpoint of an operational sound dB generated by the cleaning sequence, it can be said the longer the drive instruction time period is, the easier it is to reduce the operational sound. Comparing FIG. 4F and FIG. 4E, when the image carrier is moved a predetermined distance by taking a sufficiently long time in a state in which there is a small motor drive torque, the operational sound dB is suppressed to a relatively low sound.

In contrast, as wear of the image carrier that is the drive target of the motor increases, there is a tendency for the load applied to the motor to increase compared to when an image carrier is new. Further, even when an image carrier is new, individual differences that are within an allowable range arise in manufacturing. Hence, loads applied to the motor can differ depending on the respective image carriers. When the motor is driven over a long period as in the drive instruction time period Tβ, since the torque of the motor is small, the motor is liable to be influenced by variations in the loads of the image carriers. Because of such influence, variations may occur in the moving distance of an image carrier at the time of a cleaning sequence with respect to before and after wear of the image carrier. Occasionally, a case can arise in which even though a cleaning sequence is executed, the image carrier does not move at all. Hence, if the drive instruction time period is fixed to a value such as Tβ, variations in the moving distance of the image carrier in a cleaning sequence increase, and color shifting occurs.

Therefore, in a state in which the motor is driven in a short time such as the drive instruction time period Tα with a large current and there is a large motor drive torque, the motor control that moves an image carrier a moving distance of 1 mm can suppress variations in the moving distance. Since the motor is less prone to be influenced by variations in the load of an image carrier, variations in the moving distance in a cleaning sequence with respect to before and after wear of the image carrier are less likely to occur. In contrast, from the viewpoint of the operational sounds of the cleaning sequence, as shown in FIG. 4E, the operational sound that is generated increases. That is, it is necessary to configure a drive instruction time period T of an image carrier to a short time that is of a degree that falls inside a range that can sufficiently allow variations in the moving distance of the image carrier in the total of a plurality of times of intermittent driving.

Figure 5:
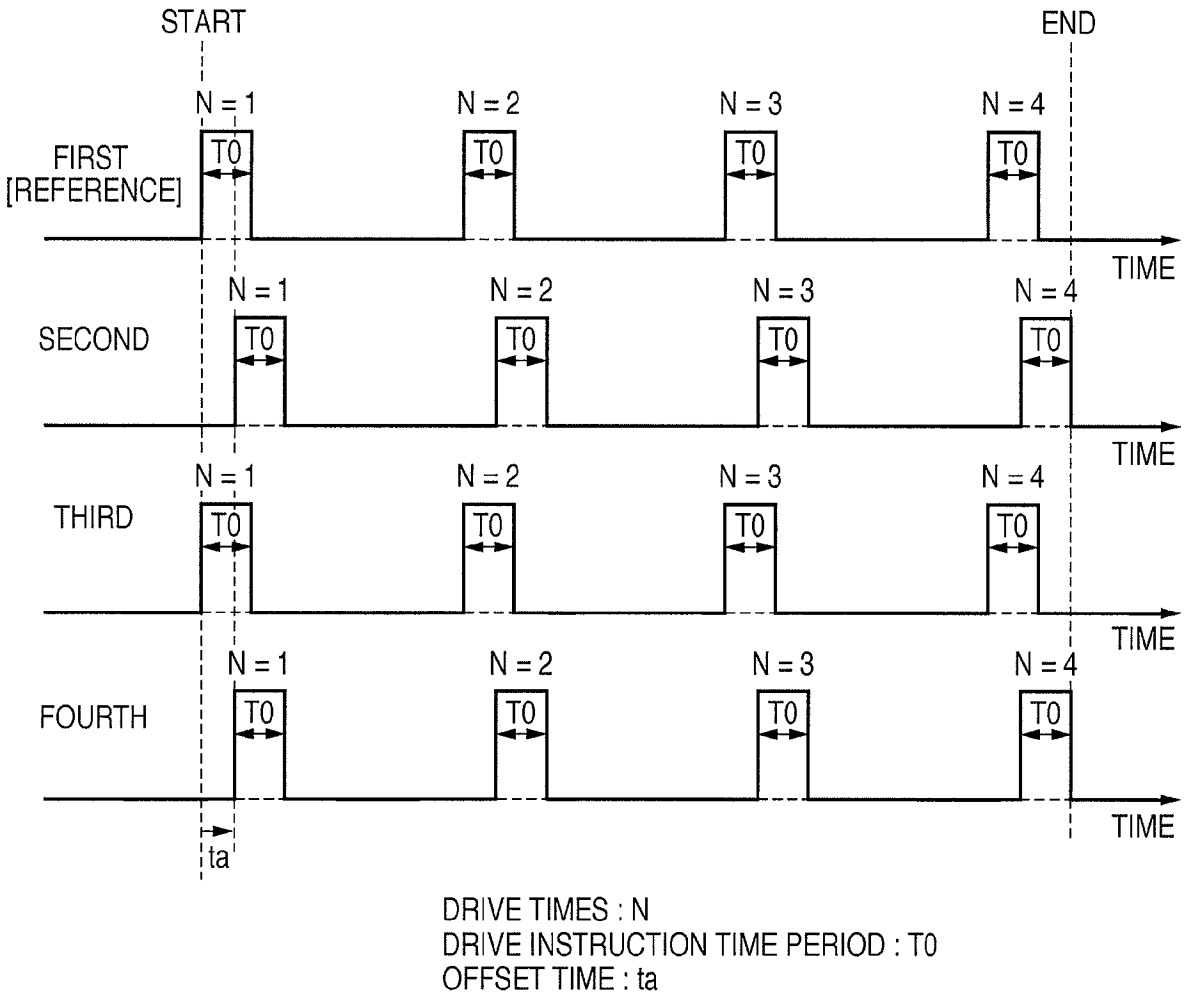
FIG. 5 is a view that illustrates an example of a cleaning sequence.
Figure 6:
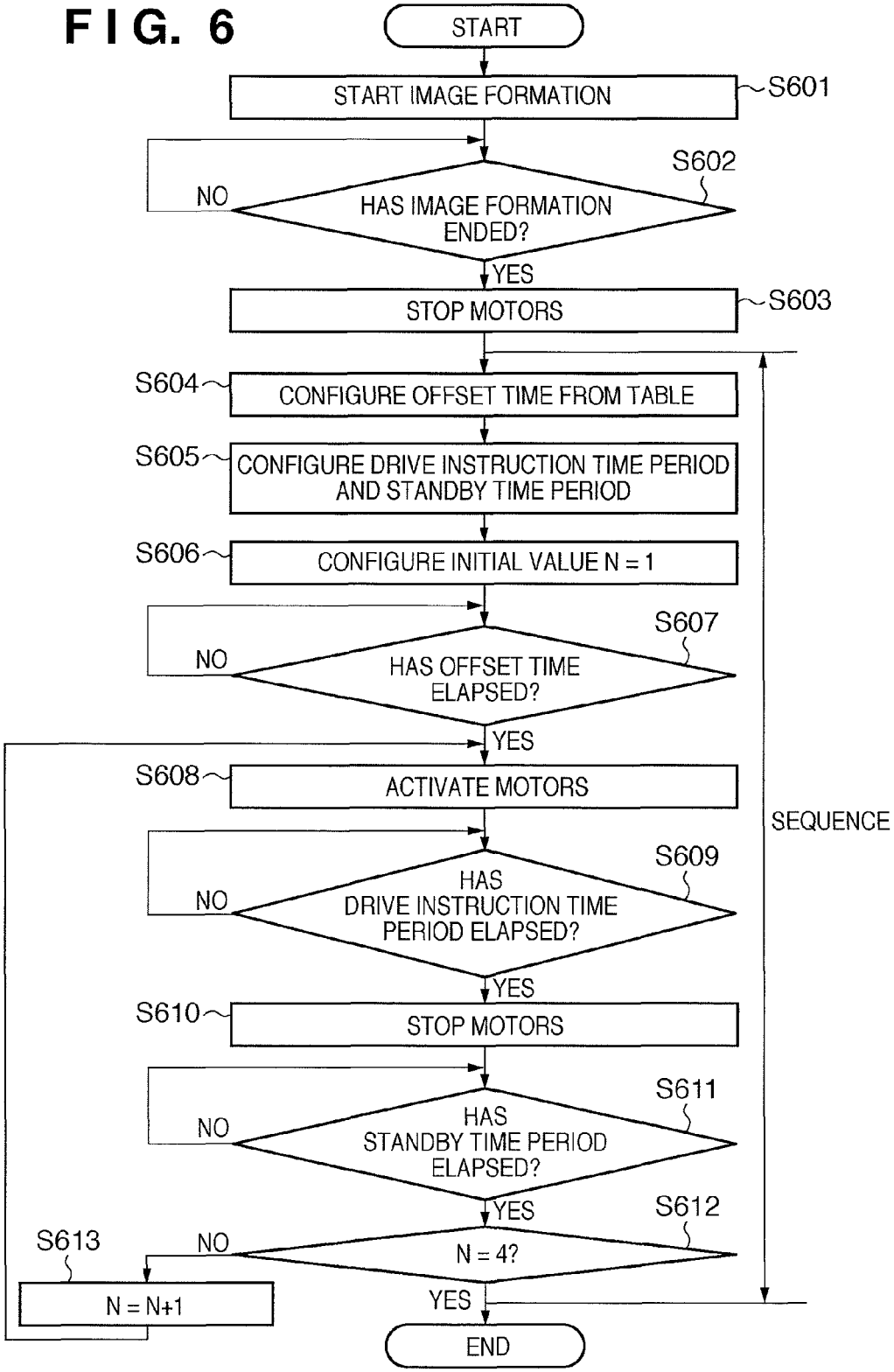
FIG. 6 is a flowchart that illustrates image formation processing that includes a cleaning sequence.

Next, control operations of a cleaning sequence are described using FIG. 5 and FIG. 6. The abscissa of FIG. 5 is the time axis. According to FIG. 5, at each station from the first to fourth station, the photosensitive drum 105 is driven by dividing the driving into four times (drive times N=1, 2, 3, 4). Each station is any one of YMCK. In each of the drive times N=1, 2, 3, 4, drive instruction time periods T0 that are configured at each station are equivalent to each other. Although not shown in the figure, a standby time period X1 is configured between two adjacent drive instruction time periods. The same also applies with respect to FIGS. 8A and 8B that is described later.

The flowchart shown in FIG. 6 illustrates the operations of a certain nth station. Since the description according to the present embodiment is based on the assumption that there are four stations, the following description assumes that four similar flowcharts exist on the same time axis. Reference character "S" in the figure denotes a step or process.

In S601, upon accepting an instruction for image formation, the CPU 114 starts an image formation operation. In S602, the CPU 114 determines whether or not the image formation operation has ended. If the image formation operation has ended, the CPU 114 proceeds to S603. In S603, the CPU 114 sends a control signal for stopping the DC brushless motors 40Y to 40K to the motor drive control circuit 43. Upon receiving the control signal, the motor drive control circuit 43 stops passage of an electric current to the DC brushless motors 40Y to 40K. As a result, the DC brushless motors 40Y to 40K stop.

Table A shown in FIG. 7A is a view that illustrates a table for configuring an initial drive start timing of each station to an offset time. The table A is stored in a storage apparatus (e.g., a RAM or ROM) that is accessible from the CPU 114. According to table A, an offset to be applied to the first and third station is zero, and an offset to be applied to the second and fourth station is ta. Thus, the drive control start timing of the first and third stations (image carriers) are commonly configured. Likewise, the drive control start timing of the second and fourth stations (image carriers) are also commonly configured. As a result, stations that are simultaneously driven are spatially distributed in a well-balanced condition. It is considered that, compared to forming pairs of stations that are arranged adjacent to each other, by forming pairs (groups) of stations by skipping at least one station therebetween and simultaneously driving the stations in parallel, operational sounds in an acoustic sense are reduced. Since the present example includes four stations, a pair of the first and third station and a pair of the second and fourth station are formed. If the example included six stations, a pair of the first and fourth station, a pair of the second and fifth station, and a pair of the third and sixth station may be formed, or a group of the first, third, and fifth stations, and a group of the second, fourth, and sixth stations may be formed. Further, in the case of six stations, a configuration may be adopted that mixes pairs that skip one station and pairs that skip four stations, such as by forming a pair of the first and fifth station, a pair of the second and fourth station, and a pair of the third and sixth station. In short, since it is possible to spatially distribute the sources of operational sounds if pairs are not formed using two adjacent stations, the operational sounds in an acoustic sense can be reduced. In this connection, the number of stations is not limited to four or six, and fundamentally the technical concept of the present invention can be applied as long as there is a plurality of stations.

In S604, the CPU 114 refers to table A to configure the initial control start timing of each station to the relevant offset time. For the first station, the CPU 114 configures zero (the CPU 114 does nothing) as an offset for the control start timing. For the second station, the CPU 114 adds ta as an offset to the control start timing. Similarly, the CPU 114 configures zero as an offset for the control start timing of the third station, and adds ta as an offset to the control start timing of the fourth station. Thus, the CPU 114 functions as an addition unit that adds respectively different offset times to the respective control start timings of a plurality of image carriers in the cleaning sequence.

In S605, the CPU 114 configures a drive instruction time period and a standby time period of the DC brushless motors 40Y to 40K of the respective stations. More specifically, the CPU 114 configures, for example, a drive instruction time period T0 and X1 as a standby time period in the first station to the fourth station. In S606, the CPU 114 assigns 1 as the initial value of a variable N for counting the drive times. In this connection, the processing from S606 to S613, which includes S606, is executed in parallel for each station. At this time, a timer that serves as a judgment target of S607 is activated by the CPU 114. In S607, the CPU 114 determines whether or not a time that corresponds to an offset time configured for the relevant station has elapsed. When the configured offset time has elapsed for a particular station, the operation advances to step S608 with respect to the station in question. In S608, the CPU 114 activates the DC brushless motors 40Y to 40K in accordance with the respective control start timings, and drives the corresponding photosensitive drums 105.

In S609, the CPU 114 determines whether or not the drive instruction time period T0 has elapsed since the control start timing with respect to each of the DC brushless motors 40Y to 40K. The CPU 114 monitors the elapsed time from the control start timing using a counter or the like. When the drive instruction time period has elapsed from the control start timing for a particular DC brushless motor among the DC brushless motors 40Y to 40K, the operation advances to step S610 with respect to the DC brushless motor in question. In S610, the CPU 114 stops the DC brushless motor for which the drive instruction time period has elapsed from the control start timing among the DC brushless motors 40Y to 40K. The CPU 114 sends a control signal that indicates that the corresponding DC brushless motor is to be stopped.

In S611, the CPU 114 determines whether or not the respectively configured standby time periods have elapsed for the DC brushless motors 40Y to 40K. When a standby time period has elapsed for a DC brushless motor among the DC brushless motors 40Y to 40K, the operation advances to step S612 with respect to the DC brushless motor in question. In S612, the CPU 114 determines whether or not the variable N for measuring the drive times is four. More specifically, the CPU 114 determines whether or not driving of the photosensitive drums 105 that is intermittently executed by dividing the driving into a plurality of times in a single cleaning sequence have all ended. If the variable N does not indicate that all the driving has ended, the operation advances to step S613. In S613, the CPU 114 increments the variable N by 1. Thereafter, the CPU 114 repeats the processing from S608 to S611. If the variable N indicates that all the driving has ended, the cleaning sequence ends.

Thus, according to the flowchart in FIG. 6, since respective control start timings of a plurality of drive units are configured to be different to each other, operational sounds generated in relation to driving a plurality of DC brushless motors are temporally distributed. As a result, operational sounds in an acoustic sense in a cleaning sequence decrease, and streaks and image blurring also decrease.

Figure 8A:
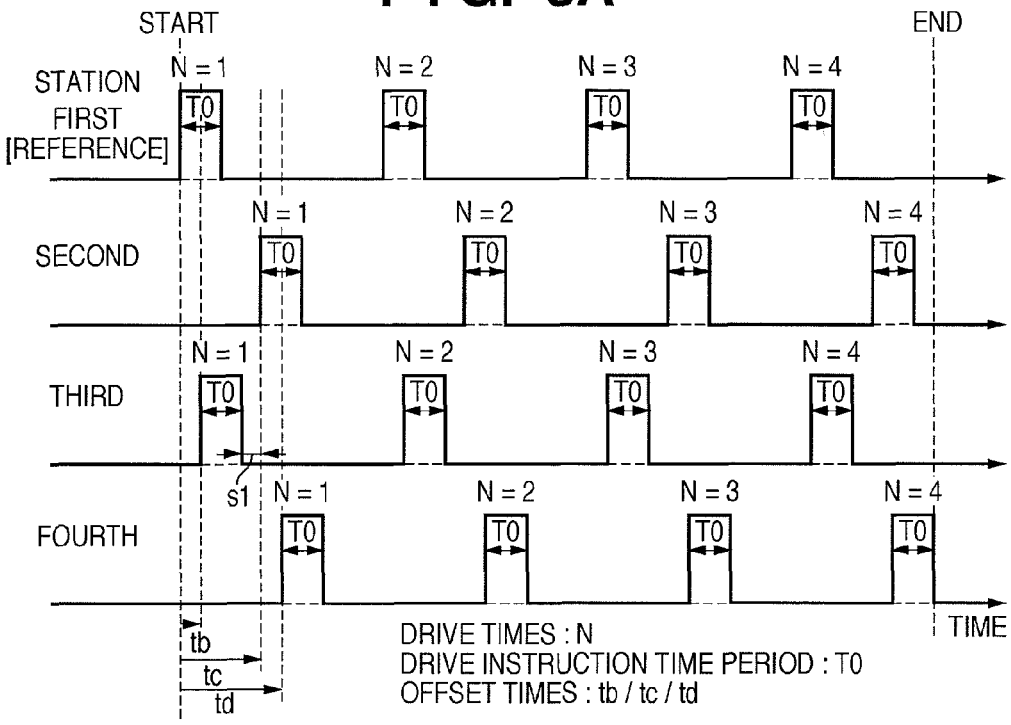
FIGS. 8A and 8B are views that illustrate examples of a cleaning sequence.
Figure 8B:
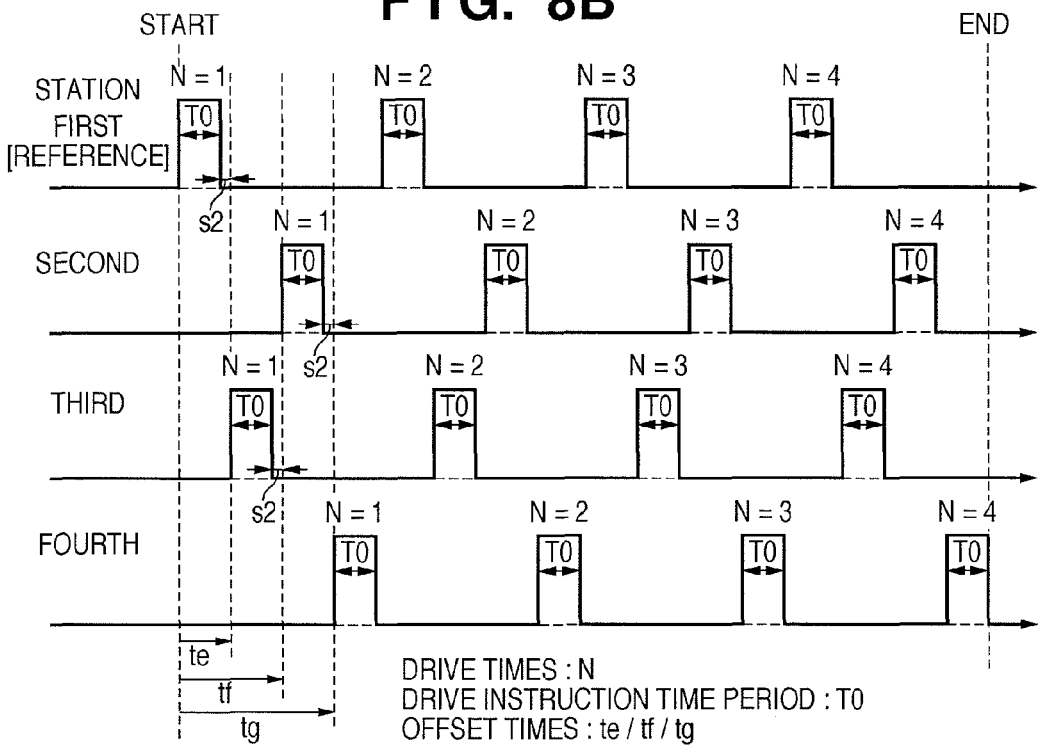

Next, a sequence obtained by modifying the cleaning sequence shown in FIG. 5 is described. FIGS. 8A and 8B are views that illustrate cleaning sequences in cases where different driving parameters are configured with respect to the sequence shown in FIG. 5. According to FIG. 7B, an offset for configuring an operational term to be applied to a first station is zero. An offset to be applied to a second station is tc. An offset to be applied to a third station is tb. An offset to be applied to a fourth station is td. The magnitude relationship between the offsets is $0<tb<tc<td$. Table B is a table for managing offset times to be referred to by the CPU 114. Table B is also stored in a storage apparatus that is accessible from the CPU 114. In S604 of the flowchart in FIG. 6 that is described above, the CPU 114 refers to table B and configures an offset time with respect to the initial drive control start timing of each station to execute the cleaning sequence shown in FIG. 8A.

As shown in FIG. 8A, by making $tc>tb+T0$, a motor stop time period s1 in which no motor of any station is driven exists within each of the same drive times. By configuring the motor stop time period s1, in addition to the advantages described in Embodiment 1, an advantage can be obtained whereby operational sounds that are generated in relation to motor driving of each station are further distributed temporally. As a result, operational sounds in an acoustic sense are further decreased.

The cleaning sequence illustrated in FIG. 8B is executed by the CPU 114 referring to a table C (FIG. 7C) in S604 of the flowchart shown in FIG. 6. In this connection, table C is also stored in a storage apparatus that is accessible from the CPU 114. According FIG. 8B, offset times te, tf, and tg are configured so that a motor stop time period s2 in which no motor of any station is driven exists within each of the same drive times. As a result, operational sounds in an acoustic sense are further decreased in comparison to the case shown in FIG. 8A.

[Embodiment 2 ]

Figure 9:
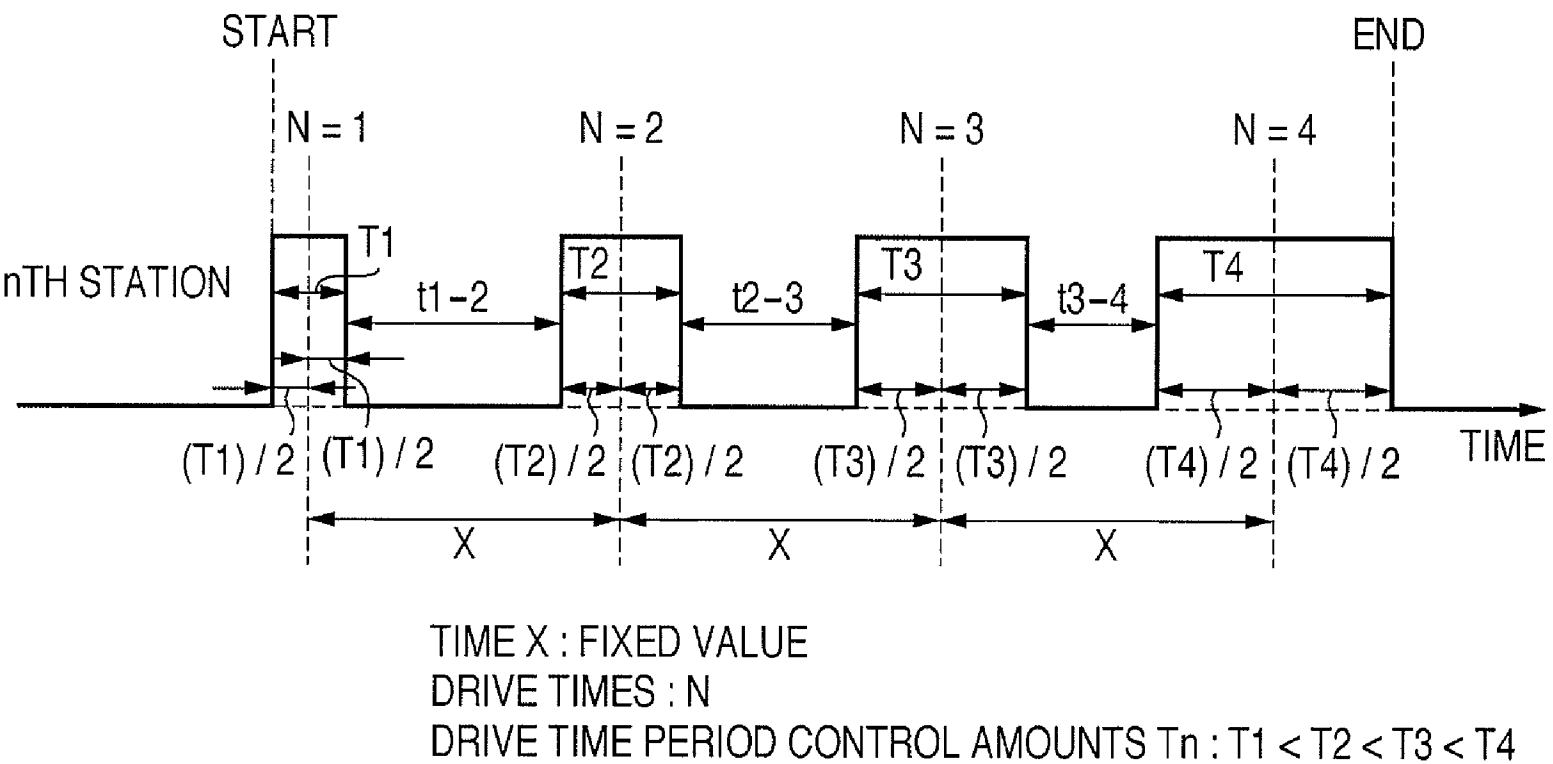
FIG. 9 is a view that illustrates an example of a cleaning sequence.

Embodiment 2 describes an example in which Embodiment 1 is developed further. A cleaning sequence shown in FIG. 9 is a cleaning sequence for removing toner remaining on the photosensitive drum 105 using the cleaning blade 109. According to the cleaning sequence, for example, the photosensitive drum 105 is stopped after being intermittently rotated in the same direction as the direction at the time of image formation. In this case, the description focuses on an nth station. The abscissa represents time.

According to FIG. 9, the photosensitive drum 105 is driven four times inside the nth station during a period from the start until the end of the sequence. More specifically, the CPU 114 and the motor drive circuit 42 and the like control a plurality of drive units so as to intermittently drive a plurality of image carriers N (N is a natural number greater than 1) times during the cleaning sequence. The Nth drive instruction time period is represented as TN. More specifically, $T_1$, $T_2$, $T_3$, and $T_4$ denote respective drive instruction time periods from the first time to the fourth time. The magnitude relationship between the drive instruction time periods is $T_1<T_2<T_3<T_4$. Thus, the CPU 114 configures the N drive instruction time periods to respectively different lengths.

There is a standby time period between two adjacent drive instruction time periods. There is a standby time period $t_{N-(N+1)}$ between the time that the Nth drive ends and the N+1th drive starts. Three standby time periods are shown is FIG. 9, namely, $t_{1-2}$ (standby time period between first and second drive), $t_{2-3}$ (standby time period between second and third drive), and $t_{3-4}$ (standby time period between third and fourth drive). The magnitude relationship between the respective standby time periods is $t_{1-2}>t_{2-3}>t_{3-4}$.

An interval between center values of two adjacent drive instruction time periods is X. As shown in FIG. 9, this interval is constant between all the center values. For example, a time interval from the center value of the first drive instruction time period to a center value of the second drive instruction time period is X, and a time interval from the center value of the third drive instruction time period to a center value of the fourth drive instruction time period is also X. When this is expressed using a numerical formula, the following relationships are established.

$$T_1/2+t_{1-2}+T_2/2=X$$

$$T_2/2t_{2-3}+T_3/2=X$$

$$T_3/2+t_{3-4}+T_4/2=X$$

Figure 10:
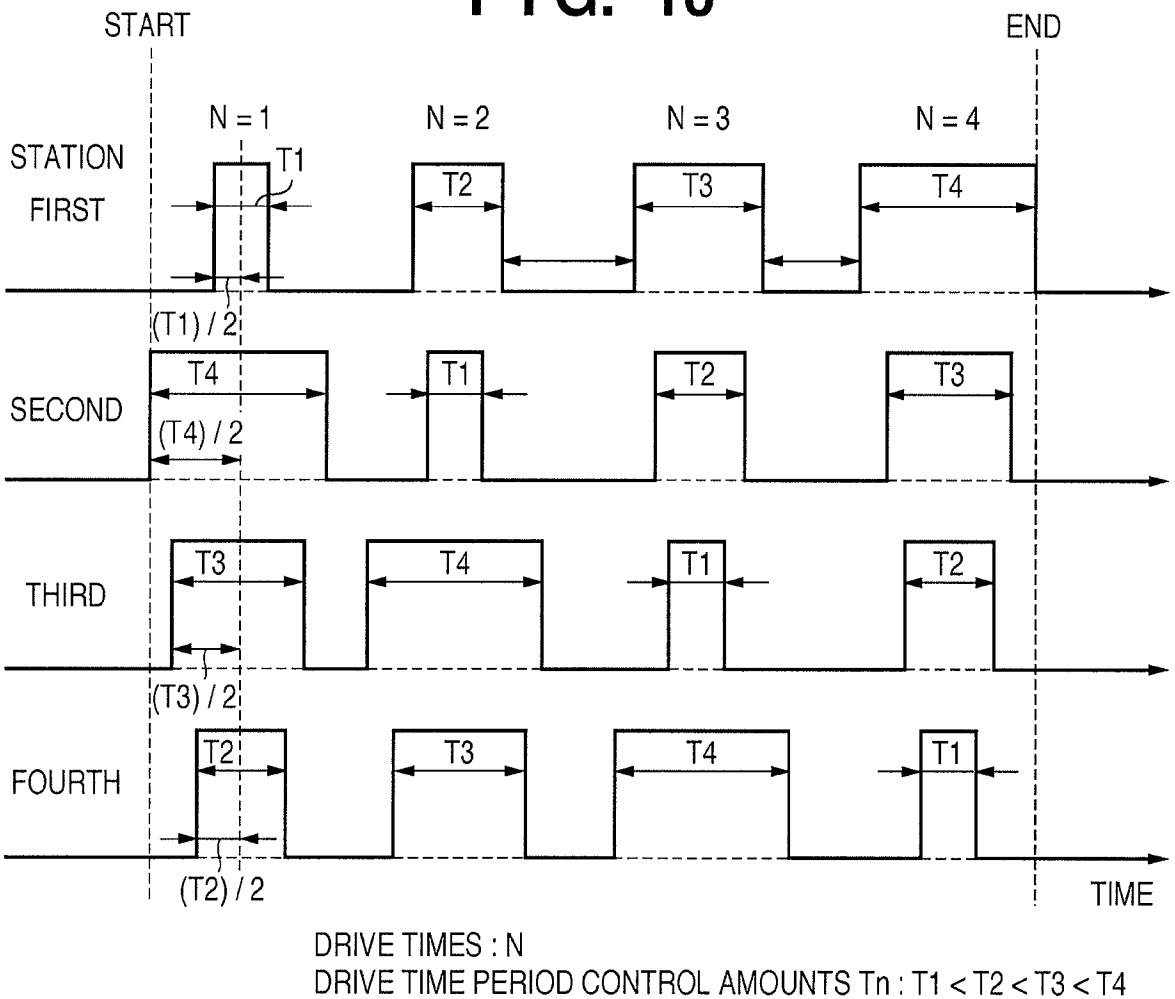
FIG. 10 is a view that illustrates an example of a cleaning sequence.

According to FIG. 10, at the first to fourth stations, the photosensitive drums 105 are driven by dividing the driving into four times (drive times N=1, 2, 3, 4). Each station is any one of YMCK.

According to FIG. 10, in each of drive times N=1, 2, 3, and 4, a drive instruction time period selected for each station is different. For example, at the first drive, the drive instruction time periods applied to the first to fourth stations are $T_1$, $T_4$, $T_3$, and $T_2$, respectively. However, $T_1$, $T_4$, $T_3$, and $T_2$ are different values to each other. Further, the total value ($TT=T_1+T_2+T_3+T_4$) of the drive instruction time periods applied at the respective stations are the same for each drive times.

At each station, the drive instruction time periods that are respectively applied for the first to fourth drives are also different to each other. For example, the drive instruction time periods that are respectively applied for the first to fourth drives at the second station are $T_4$, $T_1$, $T_2$, and $T_3$. A total time ($TH=T_1+T_2+T_3+T_4$) of the drive instruction time periods from the first to fourth drives are the same for each station. More specifically, the CPU 114 configures the drive instruction time periods so that the total time of the N drive instruction time periods is the same for each of the plurality of image carriers. This is done to reduce variations in the total moving distance of the circumference of the photosensitive drum 105 at each station, and thereby suppress streaks and image blurs.

The timings (control start timings) for starting drive control instructions for the photosensitive drum 105 at each station are respectively different. According to FIG. 10, at the initial (N=1) drive, the second station for which the longest drive instruction time period T4 is configured is used as a basis for deciding the drive start timings of the other stations. More specifically, the start timing of the cleaning sequence and the control start timing of the photosensitive drum 105 of the second station match. Further, the end timing of the cleaning sequence is a time point at which the photosensitive drum 105 of the first station that has been driven until the end in the last (N=4) drive stops. More specifically, in the last (N=4) drive, the end timing of the cleaning sequence is defined based on the first station for which the longest drive instruction time period T4 is configured. Further, as shown in FIG. 10, in each of the N drives, the centers of the drive instruction time periods of each station match each other. According to FIG. 10, the center of the drive instruction time period of each station in the first drive is $T_4/2$. In this connection, the center of the drive instruction time period of each station in the second drive is $T_4/2+X$. Thus, the CPU 114 configures the drive instruction time periods and the control start timings such that the center times of the drive instruction time periods for each drive time are equivalent for the plurality of image carriers. This has the advantage of distributing operational sounds temporally and over different frequencies.

As shown in FIG. 10, by making the drive instruction time periods and control start timings for each drive time differ for each station, the energy of operational sounds is temporally distributed, and the frequencies of operational sounds are not concentrated at only a specific frequency. Hence, acoustic operational noise is reduced.

Figure 11:
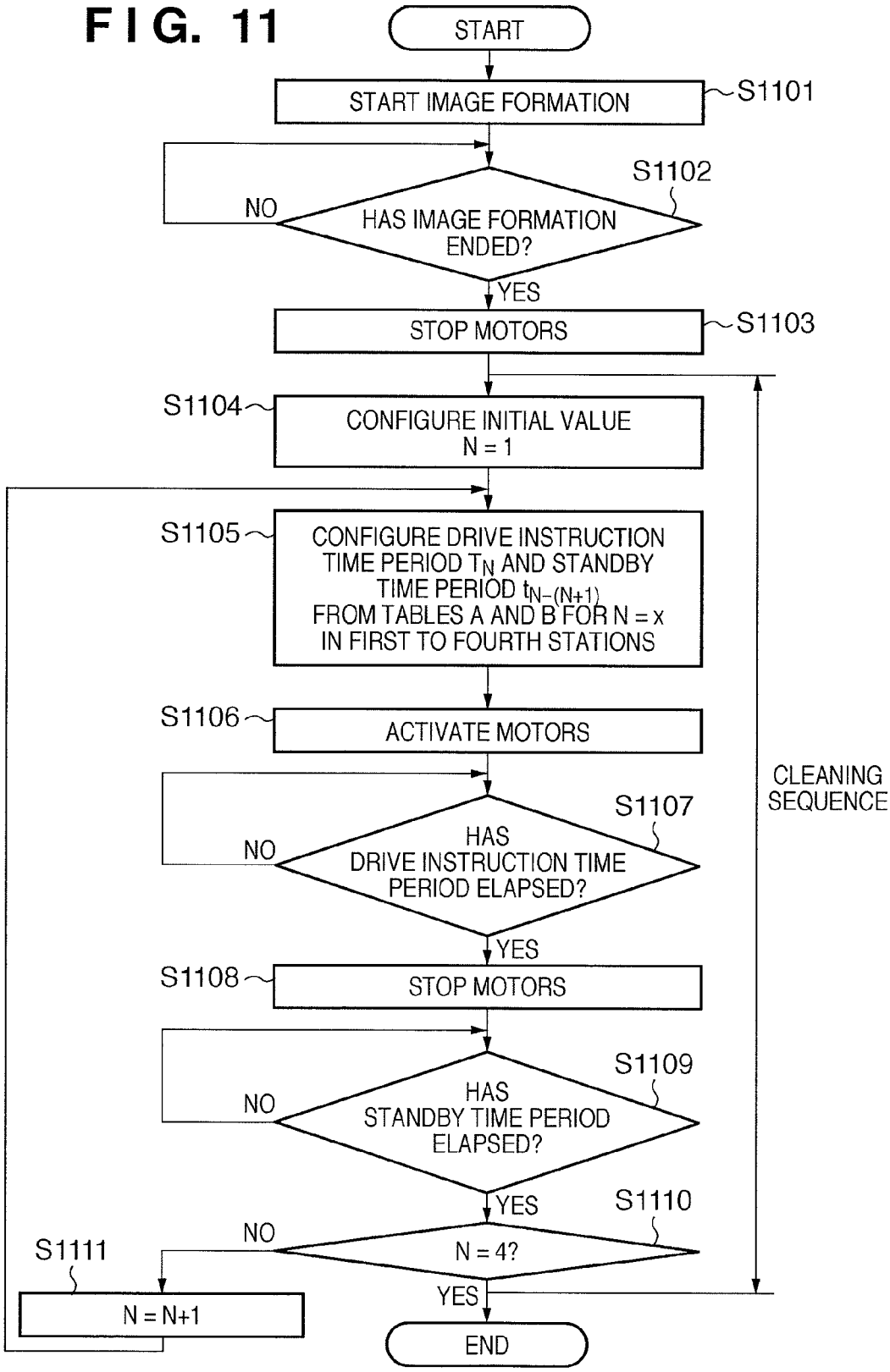
FIG. 11 is a flowchart that illustrates image formation processing that includes a cleaning sequence.

In S1101 shown in FIG. 11, upon accepting an instruction for image formation, the CPU 114 starts an image formation operation. In S1102, the CPU 114 determines whether or not the image formation operation has ended. If the image formation operation has ended, the CPU 114 proceeds to S1103. In S1103, the CPU 114 sends a control signal for stopping the DC brushless motors 40Y to 40K to the motor drive control circuit 43. Upon receiving the control signal, the motor drive control circuit 43 stops passage of an electric current to the DC brushless motors 40Y to 40K. As a result, the DC brushless motors 40Y to 40K stop.

In S1104, the CPU 114 assigns 1 as the initial value of a variable N for counting the drive times. In S1105, the CPU 114 configures drive instruction time periods, standby time periods, and drive instruction time periods and the like of the DC brushless motors 40Y to 40K in each station. Thus, the CPU 114 functions as a unit that configures so that each drive instruction time period and each control start timing of a plurality of drive units are different to each other when intermittently driving the plurality of drive units to clean a plurality of image carriers after a series of image formation processing has ended.

According to FIGS. 12A and 12B, table A and table B are stored in a storage apparatus (e.g. a RAM or ROM) that is accessible from the CPU 114. Table A records the correlations between drive instruction time periods TN of each station for each drive time. Table B records the correlations between standby time periods $t_{N-(N+1)}$ of each station for each drive time. The values recorded in table A and table B shown in FIGS. 12A and 12B are the same as the values shown in FIG. 10.

More specifically, for the first (N=1) drive, based on table A, the CPU 114 configures the drive instruction time period $T_1$ in the first station, configures $T_4$ in the second station, configures $T_3$ in the third station, and configures $T_2$ in the fourth station.

The CPU 114 also configures the control start timing in each station. As described above, the longest drive instruction time period T4 is used as a basis. The CPU 114 decides the center ($T_4/2$) of each drive instruction time period in the first drive. The CPU 114 then calculates the control start timings of other stations by subtracting half of the drive instruction time periods ($T_1$, $T_2$, and $T_3$) that have been configured for the other stations. For example, the start timing of the first station is $T_4/2-T_1/2$. In this connection, determination of the control start timing is performed only one time, that is, immediately before initially executing S1106. Further, the control start timings of each station for the second and subsequent drives are timings obtained by adding the standby time period to the drive end timing of the first drive. For example, the control start timing relating to the second drive of the first station is $T_4/2+T_1/2+t_{1-2}$. Similarly, the control start timing relating to the third drive of the first station is $T_4/2+T_1/2+t_{1-2}+T_2+t_{2-3}$.

In S1106, the CPU 114 activates the DC brushless motors 40Y to 40K in accordance with the respective control start timings that have been calculated as described above, and drives the corresponding photosensitive drums 105. In S1107, the CPU 114 determines whether or not a drive instruction time period has elapsed since the control start timing with respect to each of the DC brushless motors 40Y to 40K. The CPU 114 monitors the elapsed time from the control start timing using a counter or the like. When a drive instruction time period has elapsed from the control start timing for a particular DC brushless motor among the DC brushless motors 40Y to 40K, the operation advances to step S1108 with respect to the DC brushless motor in question. In S1108, the CPU 114 stops the DC brushless motor for which the drive instruction time period has elapsed from the control start timing among the DC brushless motors 40Y to 40K. The CPU 114 sends a control signal that indicates that the corresponding DC brushless motor is to be stopped.

In S1109, the CPU 114 determines whether or not the respectively configured standby time periods have elapsed for the DC brushless motors 40Y to 40K. As will be understood from S1105 to S1109, the CPU 114 and the motor drive control circuit 43 and the like function as a drive control unit that controls a plurality of drive units according to drive instruction time periods and control start timings that have been configured for each of the plurality of drive units by a configuration unit. When the standby time period has elapsed for a DC brushless motor among the DC brushless motors 40Y to 40K, the operation advances to step S1110 with respect to the DC brushless motor in question.

In S1110, the CPU 114 determines whether or not the variable N for measuring the number of driving times is four. More specifically, the CPU 114 determines whether or not all of the driving of the photosensitive drums 105 that is intermittently executed over a plurality of times in a single cleaning sequence has ended. If the variable N does not indicate that all the driving has ended, the operation advances to step S1111. In S1111, the CPU 114 increments the variable N by 1. Thereafter, the CPU 114 repeats the processing from S1105 to S1110. If the variable N indicates that all the driving has ended, the cleaning sequence ends.

According to the flowchart in FIG. 11, operational sounds generated in relation to driving of a plurality of DC brushless motors are distributed temporally and over different frequencies, and thus operational sounds in an acoustic sense in a cleaning sequence decrease, and streaks and image blurring also decrease. For example, by adopting a configuration in which there is a mix of long and short drive instruction time periods of motors that rotationally drive the image carrier of each station, the angular accelerations of the motors will be different to each other. As a result, the operational sound frequency will be different for each station. Hence, since the energy of operational sounds is distributed on the frequency axis, the operational sound is decreased in an acoustic sense. According to the conventional color image forming apparatus, since the same control start timing and the same drive instruction time period is applied for each station, the operational sounds are concentrated in the same time band and the same frequency. Thus, since the energy of operational sounds is concentrated in a specific time band and a specific frequency, operational sounds in an acoustic sense are liable to increase.

If operational sounds are distributed over different frequencies without being distributed temporally, it is possible to obtain an effect of reducing operational sounds in an acoustic sense to a certain degree. For example, the control start timing of each station may be aligned at the Nth photosensitive drum driving in FIG. 10.

Further, as shown in FIG. 10, the total drive instruction time periods are the same for each station. Even if there are slight differences among the total drive instruction time periods at each station, the total drive instruction time periods can be considered to be approximately identical as long as the slight differences are of a degree such that substantially the same effects are obtained. More specifically, the total moving distances of the circumference of each image carrier in the cleaning sequence are at least approximately equivalent. However, when there is an eccentric component in the circumferential speeds of the photosensitive drums, so-called "color shifting" can arise. To suppress color shifting, for example, the phases of speed variations between the photosensitive drums may be adjusted. In this situation, since the total drive instruction time periods at each station become the same or approximately the same, it is possible to avoid destroying the phase relationship that has been ideally adjusted from the viewpoint of color shifting.

[Embodiment 3 ]

Embodiment 3 is an invention that adds a technical concept of configuring time differences (offsets) with respect to start times of cleaning sequences among respective motors to the technical concept of Embodiment 2. Hereunder, a description of matters that are common to Embodiment 2 is omitted.

Figure 13:
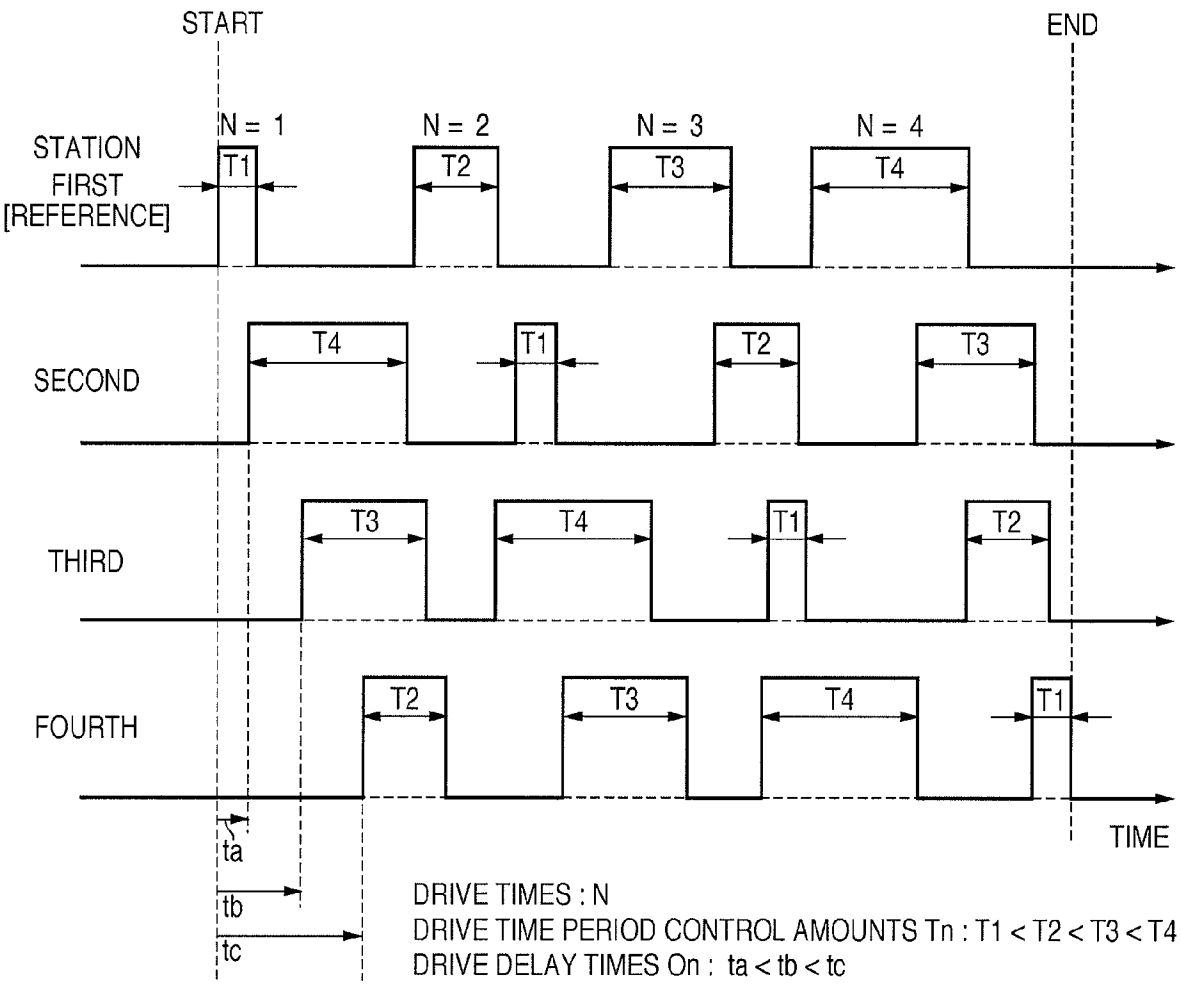
FIG. 13 is a view that illustrates an example of a cleaning sequence.

According to FIG. 13, an offset applied to the first station is zero. An offset applied to the second station is ta. An offset applied to the third station is tb. An offset applied to the fourth station is tc. The magnitude relationship between the offsets is $0<ta<tb<tc$.

A table C shown in FIG. 14 holds an offset (drive delay time period) for each station. Table C is also stored in a storage apparatus that is accessible from the CPU 114.

As will be understood from FIG. 13 and FIG. 14, the CPU 114 adjusts the control start timings determined according to Embodiment 2 according to the offsets in table C. For the first station, the CPU 114 makes a change such that the control start timing of the first driving is zero. For the second station, the CPU 114 adds to as an offset to the control start timing of the first driving. The CPU 114 adds tb to the control start timing of the third station, and adds tc to the control start timing of the fourth station.

Figure 15:
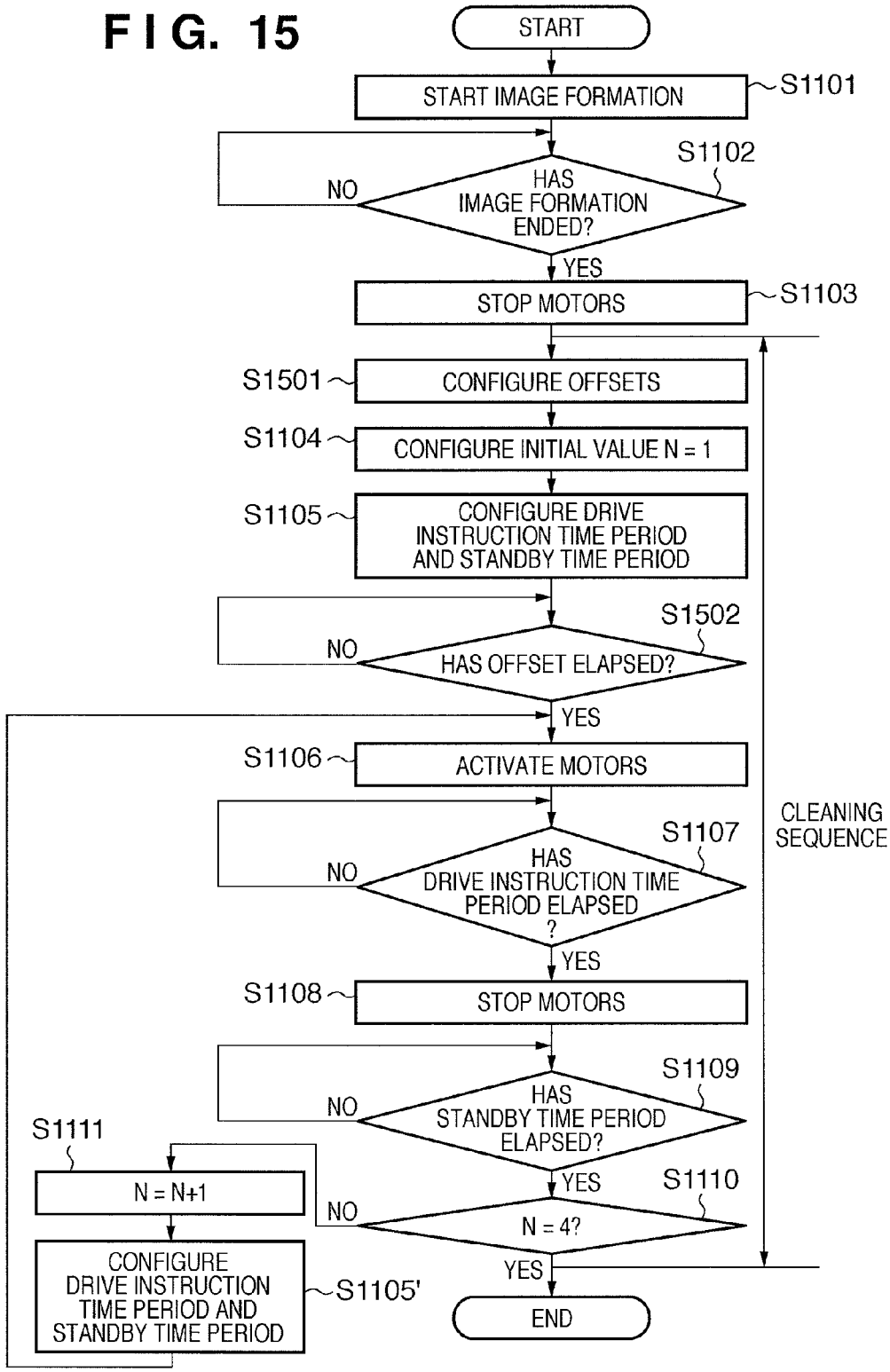
FIG. 15 is a flowchart that illustrates image formation processing that includes a cleaning sequence.

Compared to Embodiment 2, Embodiment 3 as illustrated in FIG. 15 includes S1501 that is newly added between S1103 and S1104. Further, S1502 is newly added between S1105 and S1106. After executing S1101 to S1103, the operation proceeds to S1501.

In S1501, the CPU 114 refers to table C to configure an offset for the initial control start timing of each station. Thereafter, the CPU 114 executes S1104 and S1105 and proceeds to S1502. In S1502, the CPU 114 determines whether or not time periods corresponding to the offsets configured for each station have elapsed. The CPU 114 proceeds to step S1106 with respect to stations for which the configured offset has elapsed. In this connection, after executing S1111, the CPU 114 executes step S1105' that is equivalent to S1105, and then proceeds to step S1106.

As described above, according to Embodiment 3, in addition to the advantages described in Embodiment 2, an advantage is obtained whereby operational sounds are further distributed temporally. As a result, operational sounds in an acoustic sense are further reduced.

[Embodiment 4 ]

According to Embodiment 4, a technical concept is described that adds a control sequence of the fan motor 112 that functions as a cooling apparatus to the technical concepts described in Embodiments 1 to 3. The fan motor 112 is an example of a cooling unit for cooling the inside of an image forming apparatus. A cooling unit other than a fan may also be adopted as long as the cooling unit generates an operational sound.

Generally, when the fan motor 112 is driven, operational sounds that are acoustically perceivable are generated. Hence, according to Embodiment 4, by suitably configuring the operation timing of the fan motor 112, it is possible to both maintain a cooling effect and reduce auditory operational sounds. Hereunder, a description of matters that are common to Embodiments 1 to 3 is omitted.

Figure 16:
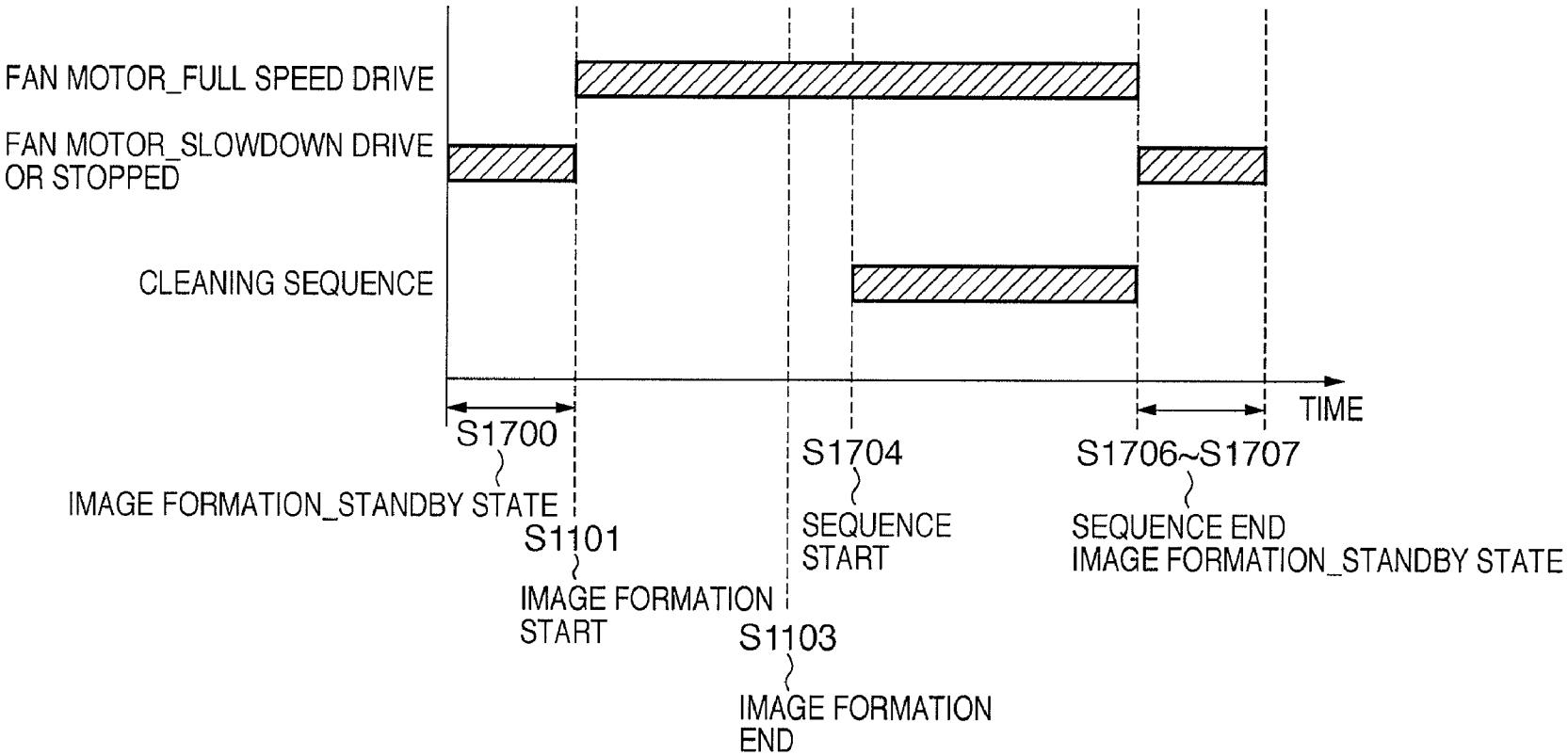
FIG. 16 is a view that illustrates the relationship between operating states of a fan motor and a cleaning sequence.

According to FIG. 16, a state in which the fan motor 112 is being driven with 100% of the voltage that can be applied from the fan motor control circuit 80 is defined as "full speed drive". In contrast, a state in which the fan motor 112 is rotating at a lower rotational speed (e.g. 50%) than the rotational speed of the fan motor 112 in full speed drive state is defined as "slowdown drive". Slowdown drive can be implemented by the fan motor control circuit 80 decreasing the voltage applied to the fan motor 112. In this connection, the fan motor control circuit 80 may be configured to change the voltage applied to the fan motor 112 to an arbitrary percentage. Therefore, full speed drive may be realized with, for example, an applied voltage of 70% relative to the maximum applicable voltage. In this case, slowdown drive can be realized by an applied voltage that is, for example, 30% less than the full speed drive.

According to FIG. 16, in the idle state denoted by S1700, the fan motor 112 is being subjected to slowdown drive. When image formation is started in S1101, the fan motor 112 is subjected to full speed drive. When image formation ends in S1103, in general the fan motor 112 will switch from full speed drive to slowdown drive. However, according to the present invention, since a cleaning sequence is executed in S1704, the fan motor 112 continues to be subjected to full speed drive. When the cleaning sequence ends in S1706, the fan motor 112 switches from full speed drive to slowdown drive. Since some acoustically perceivable operational sounds are generated from the motors while the cleaning sequence is being executed, it is difficult to distinguish the operational sound of the fan motor 112. Hence, by subjecting the fan motor 112 to full speed drive during the period of the cleaning sequence, a cooling effect and heat exhaust effect can be enhanced.

Figure 17:
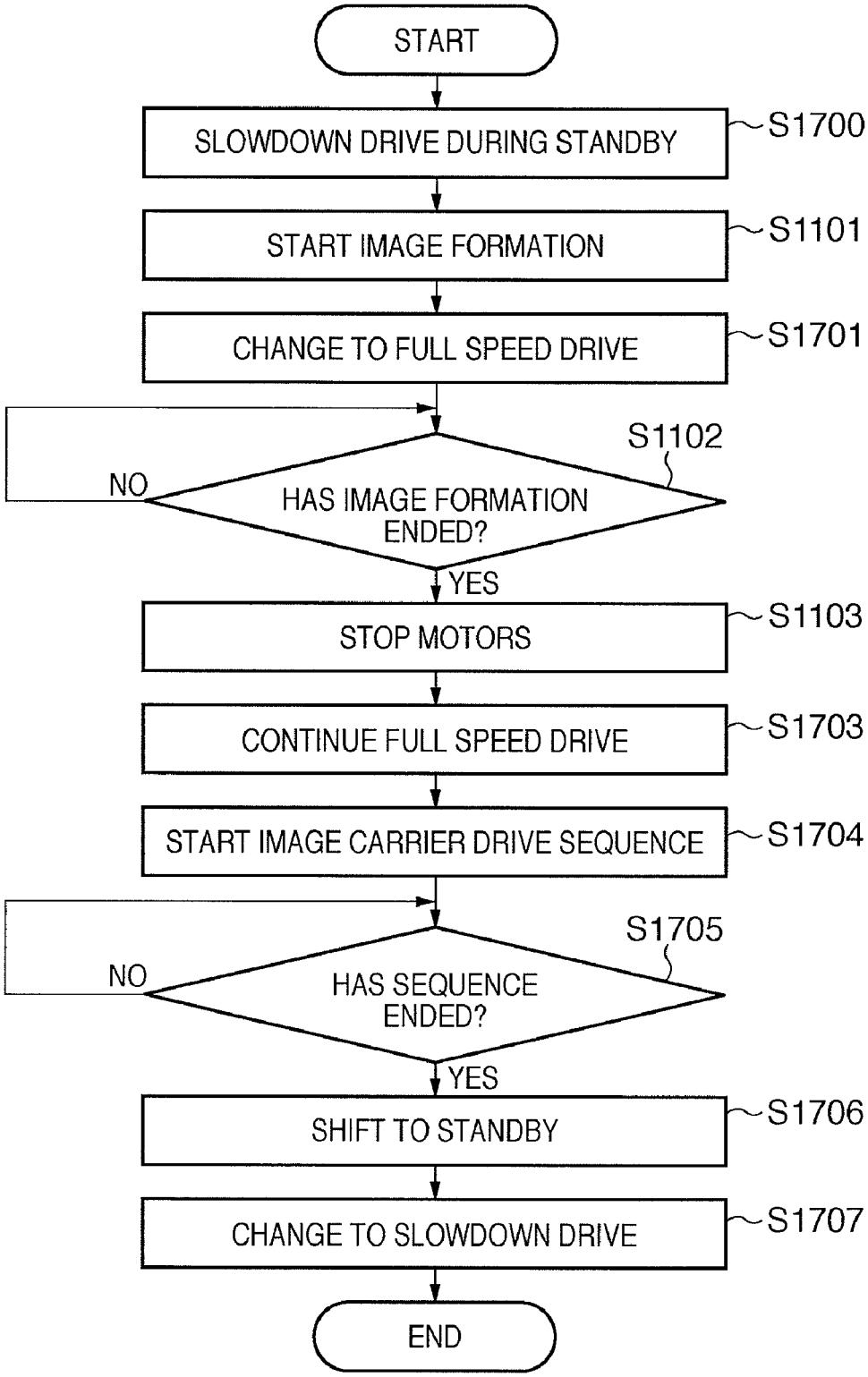
FIG. 17 is a flowchart that illustrates image formation processing that includes a cleaning sequence.

According to FIG. 17, in S1700, since the current state is a standby state, the CPU 114 sends a slowdown drive instruction to the fan motor control circuit 80. Upon receiving the slowdown drive instruction, the fan motor control circuit 80 subjects the fan motor 112 to slowdown drive. During standby, a state is entered in which the proportion of current applied to each portion of the laser printer 100 decreases. Hence, the volume of air required for cooling and exhausting heat decreases compared to the volume of air at the time of image formation. Upon receiving an instruction to start image formation, the CPU 114 proceeds to S1101. After S1101, the CPU 114 proceeds to S1701 and sends a full speed drive instruction to the fan motor control circuit 80. Upon receiving the full speed drive instruction, the fan motor control circuit 80 subjects the fan motor 112 to full speed drive. Thereafter, the CPU 114 proceeds to S1102, and when image formation has ended, the motors are stopped in S1103. Since the image formation operation ends, a state is entered in which the current applied to each unit decreases. However, according to the present embodiment, the CPU 114 proceeds to S1703 and continues the full speed drive. Thereafter, the CPU 114 proceeds to S1704 to shift to a cleaning sequence. The cleaning sequence corresponds to S1104 to S1110 (FIG. 11) in Embodiment 2 or S1501 to S1110 (FIG. 15) in Embodiment 3.

In S1705, the CPU 114 determines whether or not the cleaning sequence has ended. If the cleaning sequence has ended, the CPU 114 proceeds to S1706. In S1706, the CPU 114 shifts to an image formation standby state. In S1707, the CPU 114 sends a slowdown drive instruction to the fan motor control circuit 80 so as to subject the fan motor 112 to slowdown drive.

According to the present embodiment, in addition to operating the cooling unit while executing image formation processing in the image forming apparatus, the CPU 114 also operates the cooling unit while the plurality of drive units are intermittently operating. Thereby, in addition to the advantages of Embodiments 1 to 3, the present embodiment can provide an advantage whereby cooling and heat exhausting can be maintained while decreasing acoustic operational noise of the fan motor 112. Generally, since the frequency of operational sounds generated from each station and the frequency of operational sounds generated from the fan motor 112 are different, the energy of acoustic operational noise is not increased very much even if the aforementioned operational sounds are superimposed on each other. Alternatively, operational sounds generated from the fan motor 112 are difficult to distinguish due to the operational sounds generated from each station. Hence, acoustically perceivable operational sounds of the fan motor 112 decrease.

[Other Embodiments ]

Although according to Embodiment 4, 50% or 30% of full speed drive are described as examples of slowdown drive, slowdown drive also includes a state in which driving of the fan motor 112 is stopped. Further, the laser printer 100 may include a plurality of fan motors 112. In this case, driving a majority of the fan motors 112 corresponds to full speed drive, and driving less than that number of fan motors 112 corresponds to slowdown drive.

According to each of the foregoing embodiments, after the photosensitive drum 105 stops temporarily, the photosensitive drum 105 is intermittently rotated a plurality of times in the same direction as the direction at image formation. Naturally, a cleaning sequence may also be adopted whereby the photosensitive drum 105 is stopped after being further rotated in the reverse direction after being rotated a plurality of times in the same direction as the direction at image formation. Although a DC brushless motor is exemplified as a drive unit of the photosensitive drum 105, another kind of drive source may also be adopted. Further, although in the foregoing embodiments the laser printer 100 includes four stations, the number of station may be two or more. While the number of driving times in the cleaning sequence described above is taken as four, the number of driving times can be arbitrarily configured as long as the number is two or more. Although in the above embodiments there are four kinds of drive instruction time periods (T1, T2, T3, and T4), there may be two or more kinds of drive instruction time periods. Further, the standby time periods after stopping the motors can be configured in an arbitrary range. The offsets of the control start timing can also be configured in an arbitrary range.

Further, although the foregoing embodiments describe configurations in which an image carrier of one station is driven by one motor, the present invention may also be applied to a configuration in which a plurality of image carriers of two or more stations are driven with one motor. For example, in Embodiment 1, the first station and third station may be driven with a common DC brushless motor and a second station and a fourth station may be driven with a common DC brushless motor.

Further, in the foregoing description, the cleaning sequence was performed by controlling the image carriers to rotate intermittently a plurality of times and stop. However, the present invention is also applicable to a cleaning sequence in which, after an image carrier temporarily stops, the image carrier is rotated intermittently a plurality of times in the same direction as the direction at image formation, and is next rotated in the opposite direction and is then stopped. For example, a drive instruction time period T may be configured so that the moving distance of an image carrier is from 5 mm to 10 mm at the time of rotation in the reverse direction. It is to be understood that the numerical value of the moving distance is selected by taking into account the configurations of and variations between respective image forming apparatuses. Further, although the number of drive times of the cleaning sequence is described above as four times, it is to be understood that the number of drive times can be arbitrarily configured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-141622, filed Jun. 12, 2009, which is hereby incorporated by reference herein in its entirety.

What is claimed is:

1. An image forming apparatus, comprising:

a plurality of image carriers that carry images formed by a developer;

a plurality of drive units that drive said plurality of image carriers;

a plurality of cleaning members that clean developer on said plurality of image carriers, respectively;

a drive control unit that controls operations of said plurality of drive units until drive of said plurality of image carriers is ended after an image is respectively formed on said plurality of image carriers; and a configuration unit that configures driving parameters of said plurality of drive units differently with respect to said plurality of drive units, the driving parameters setting a restart timing of restarting drive of said plurality of image carriers which is suspended until drive of said plurality of image carriers is ended after an image is respectively formed on said plurality of image carriers, wherein said drive control unit operates said plurality of drive units according to driving parameters configured by said configuration unit.

2. The image forming apparatus according to claim 1, wherein said drive control unit is further configured to control a timing of starting drive control of said plurality of drive units by the driving parameters.

3. The image forming apparatus according to claim 2, wherein said configuration unit configures the driving parameters so that, after driving of any drive unit among said plurality of drive units is suspended, driving of any other drive unit starts.

4. The image forming apparatus according to claim 1, wherein:

first, second, third, and fourth image carriers as said plurality of image carriers are arranged in parallel for sequentially superimposing images; and said configuration unit commonly configures the driving parameters of said first and third image carriers, and commonly configures the driving parameters of said second and fourth image carriers.

5. The image forming apparatus according to claim 1, wherein:

said drive control unit controls said plurality of drive units so as to intermittently drive said plurality of image carriers N times (N is a natural number of 2 or more), respectively; and said configuration unit configures drive instruction time periods of the N times as the driving parameters to respectively different lengths.

6. The image forming apparatus according to claim 5, wherein said configuration unit configures the drive instruction time periods so that a total time obtained by adding the drive instruction time periods of the N times is the same or approximately the same for each of said plurality of image carriers.

7. The image forming apparatus according to claim 1, wherein:

each of the driving parameters includes a drive instruction time period and a control start timing; and said configuration unit configures the drive instruction time period and the control start timing so that a center time of the drive instruction time period of each time is the same or approximately the same for each of said plurality of image carriers.

8. The image forming apparatus according to claim 1, further comprising:

a cooling unit for cooling the inside of said image forming apparatus; and a cooling control unit that controls starting and stopping of operations of said cooling unit, wherein, in addition to operating said cooling unit during execution of image formation processing at said image forming apparatus, said cooling control unit operates said cooling unit while said plurality of drive units are intermittently operating, and subjects said cooling unit to slowdown drive in accordance with ending of the intermittent operations.

9. A control method of an image forming apparatus comprising a plurality of image carriers that carry images formed with developer, a plurality of drive units that drive said plurality of image carriers, and a plurality of cleaning members that clean developer on the plurality of image carriers, respectively, the method comprising:

a drive control step of controlling operations of the plurality of drive units until drive of the plurality of image carriers is ended after an image is respectively formed on the plurality of image carriers; and a configuration step of configuring driving parameters of the plurality of drive units differently with respect to the plurality of drive units, the driving parameters setting a restart timing of restarting drive of the plurality of image carriers which is suspended until drive of the plurality of image carriers is ended after an image is respectively formed on the plurality of image carriers, wherein said drive control step includes a step of operating the plurality of drive units according to the driving parameters configured in said configuration step.

10. The image forming apparatus according to claim 1, wherein a next timing of driving said plurality of image carriers after drive of said plurality of image carriers is ended is a timing of starting a next image formation.

11. The image forming apparatus according to claim 1, wherein said configuration unit is further configured to configure the driving parameters such that driving terms of said plurality of image carriers are different from each other after said plurality of image carriers is suspended and restarted.

12. The image forming apparatus according to claim 1, wherein said plurality of drive units rotate said plurality of drive image carriers a small extent when said plurality of drive units suspend drive of said plurality of image carriers and restart the drive of said plurality of image carriers.

13. The image forming apparatus according to claim 1, wherein said plurality of cleaning members are cleaning blades.

14. The image forming apparatus according to claim 1, wherein said plurality of cleaning members respectively contact said plurality of image carriers at least until drive of said plurality of image carriers is ended after an image is respectively formed on said plurality of image carriers.

15. An image forming apparatus, comprising:

a plurality of image carriers that carry images formed by a developer;

a plurality of drive units that drive said plurality of image carriers;

a plurality of cleaning members that clean developer on said plurality of image carriers, respectively;

a drive control unit that controls operations of said plurality of drive units until drive of said plurality of image carriers is ended after an image is respectively formed on said plurality of image carriers; and a configuration unit that configures driving parameters for changing a drive mode of said plurality of drive units from a first mode to a second mode differently with respect to said plurality of drive units until drive of said plurality of image carriers is ended after an image is respectively formed on said plurality of image carriers, wherein said drive control unit operates said plurality of drive units according to driving parameters configured by said configuration unit.

16. The image forming apparatus according to claim 15, wherein the first mode is a mode for said plurality of cleaning members cleaning said plurality of image carriers, and the second mode is performed to rotate said plurality of image carriers a small extent after the first mode is performed.

17. A control method of an image forming apparatus comprising a plurality of image carriers that carry images formed with developer, a plurality of drive units that drive the plurality of image carriers, and a plurality of cleaning members that clean developer the plurality of image carriers, respectively, the method comprising:

a drive control step of controlling operations of the plurality of drive units until drive of the plurality of image carriers is ended after an image is respectively formed on the plurality of image carriers, and a configuration step of configuring driving parameters for changing a drive mode of the plurality of drive units from a first mode to a second mode differently with respect to the plurality of drive units until drive of the plurality of image carriers is ended after an image is respectively formed on said plurality of image carriers, wherein said drive control step includes a step of operating the plurality of drive units according to driving parameters configured in said configuration step.

* * * * *